US010723420B1

(12) United States Patent
Jaegers et al.

(10) Patent No.: US 10,723,420 B1
(45) Date of Patent: Jul. 28, 2020

(54) WATER SLIDE TUBE WITH BRAKING WHILE HYDROPLANING

(71) Applicant: DISNEY ENTERPRISES, INC., Burbank, CA (US)

(72) Inventors: Tyler M. Jaegers, Orlando, FL (US); Aaron M. Foster, Orlando, FL (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

(21) Appl. No.: 16/371,491

(22) Filed: Apr. 1, 2019

(51) Int. Cl.
*B63B 34/50* (2020.01)
*A63G 21/18* (2006.01)

(52) U.S. Cl.
CPC ..... *B63B 34/50* (2020.02); *A63G 21/18* (2013.01)

(58) Field of Classification Search
CPC .... B63B 1/00; B63B 7/02; B63B 7/08; B63B 32/00; B63B 32/20; B63B 32/51; B63B 35/00; A63H 23/00
USPC ..... 472/117, 128–129; 280/18, 19; 441/129–132
See application file for complete search history.

(56) References Cited

U.S. PATENT DOCUMENTS 3,581,328 A * 6/1971 Smith ..... B63B 32/20 441/67
3,871,042 A * 3/1975 Farmer ..... B63B 7/08 114/346
4,366,963 A * 1/1983 Reeves ..... B63B 7/082 280/18.1
4,552,539 A * 11/1985 Hoenstine ..... B63B 34/50 441/66
6,746,291 B1 * 6/2004 Coleman ..... B63B 32/51 441/65
6,981,706 B1 * 1/2006 Kramer ..... B62B 13/125 280/18.1
7,597,601 B2 * 10/2009 Mravca ..... A63B 69/14 441/129
2013/0323992 A1 * 12/2013 Berenson ..... A63H 23/00 441/131

* cited by examiner

*Primary Examiner* — Kien T Nguyen
(74) *Attorney, Agent, or Firm* — Snell & Wilmer LLP; Kent A. Lembke

(57) ABSTRACT

A water slide tube adapted for braking during hydroplaning in a catch or landing pool of a water slide. The water slide tube includes a tube body and a tube speed control assembly, which has a floor attached to a bottom surface of the tube body. The assembly includes one or more drag-inducing elements, provided in or on the floor, configured to produce drag when an outer surface of the floor travels over an upper surface of the catch or landing pool. The floor includes a sheet of flexible material joined along its peripheral edge to the tube body. The sheet of the floor includes a planar portion arranged to be tangential to the bottom surface of the tube body. The one or more drag-inducing elements may include at least one hole extending through the floor providing a passageway for water to an interior space of the tube body.

25 Claims, 8 Drawing Sheets

DETAIL B
SCALE 1.5 : 1

DETAIL B
SCALE 1.5 : 1

WATER SLIDE TUBE WITH BRAKING WHILE HYDROPLANING

BACKGROUND

1. Field of the Description

The present description relates, in general, to water slide systems and rider tube designs for water slide systems, and, more particularly, to water slide tubes for use by one or more riders in a water slide (such as a speed slide). The new water slide tubes are designed to provide controlled deceleration or braking of the tube in a landing or catch pool while retaining desirable ride stability (e.g., to limit tipping upon entering the landing or catch pool).

2. Relevant Background

Water slides are a type of slide designed for warm weather or indoor recreational use as part of water parks. Some water slides require riders to sit on a tube or "water slide tube" that is designed to be used with the slide, with water slides using such a tube being classified as "tube slides" and those that exceed a certain speed (such as 25 ft/s) and using a tube being "tubed speed slides." A typical water slide uses a pump system (or water circulation system) to pump water to the top of the slide, and the water is then allowed to freely flow down the inner slide or flume surfaces. The water reduces friction between the water slide tube with its rider and the inner surfaces of the slide, when the rider travels faster than the water (e.g., in speed slides or downward valley sections of water coasters), so riders or sliders travel down the slide or flume very quickly. Other slides are designed to have the water push the rider through the slide. Many water slides are designed to run or empty into a landing or catch pool located at the end or outlet of the slide or flume, and safety is promoted by providing a lifeguard and/or control system that only allows a next rider to start the slide after the prior rider has exited the landing or catch pool.

There has been a growing demand for new water slides including speed slides that use tubes to attract a wider age range of riders. Challenges in designing the new water slides include how to provide a safe and enjoyable end to the slide experience while also achieving a relatively high throughput (e.g., without a long delay for riders exiting the catch or landing pool). Landing pools for water slides with riders on tubes, specifically speed slides, are designed to be of adequate length to decelerate and stop riders without contacting pool end walls or stationary objects.

To hasten rider exit and reduce space and water requirements, it would be desirable to shorten the length and depth of the landing pool in many applications. However, the length and depth of the landing pool often has to be relatively large because of varying rider stop distances and speeds. The parameters that cause the stop distance for riders on water slide tubes to vary include rider size, slide profile, slide water flow, rider stability upon entering the landing pool, the rider's ability to hydroplane across the top of the water in the landing pool, and more.

With regard to hydroplaning, landing pools often will not have a drop entry but, instead, the outlet of the flume is at about the same height as the top of the water in the landing pool. The riders have the capability to flatten out their bodies across the top of the water slide tube in order to disperse body weight and lessen drag between the water surface in the landing pool and the bottom of the water slide tube. This rider action induces hydroplaning and allows the riders to reach much farther distances than if they simply sat up in the water slide tube, which has forced designers of water slides to provide a much longer landing pool to try to stop riders from reaching the back wall of the landing pool. Often, these long-stopping riders then have to walk or swim back towards the flume outlet to climb or step out of the landing pool, which can delay the next rider from starting the water slide. However, while long stopping distances are often undesirable, stability is improved while hydroplaning and, therefore, it is desirable to control stopping distances while still allowing hydroplaning.

A wide range of rider sizes and riding styles creates a complex design problem of how to stop each rider, regardless of their size and riding style, in a consistent and safe zone in the landing pool. Methods in place today can achieve desired stop location results, but these tube stopping techniques often require changes to landing pool design and sacrifice rider stability and consistency. For example, many water slides are configured to produce a hydraulic jump at the outlet of the slide or its flume by providing a wave at the end of the slide. This limits hydroplaning but can cause the tube to become unstable, and the rider can lose balance so that the tube tips and the rider is forced off the tube. Such a loss of stability and inconsistent ending of a water slide ride can be undesirable for many water slide designers and operators.

Hence, there remains a need for a means of decelerating or braking riders of tubes at the end of water slides. Preferably, the new braking technology slows the tube in a way that allows the riders to hydroplane for an increase in stability (e.g., skim over the water surface) and constantly stop in a relatively short distance (or in a desired zone near the slide or flume outlet).

SUMMARY

The inventors determined that it would be desirable to create a new design for a water slide tube rather than requiring modifications to other portions of the water slide system such as the landing or catch pool. However, due to the unique braking ability of the new water slide tube including its stopping ability and rider/tube stability, future water slide designs may be created with a shorter landing or catch pool than was possible with prior tube designs and with shallower portions to allow quicker exits by riders.

In brief, the water slide tube includes an inner tube that is inflated to a desired air pressure (e.g., a conventional circular tube with a center hole extending through), and the inflated inner tube is retained within a cover or outer coating (e.g., a thin sheet of plastic or fabric), which often will include side handles for a rider to hold onto during the ride in a water slide. In other embodiments, no cover is provided with the water slide tube only having the inner or fillable tube (e.g., a PVC or other fabric/material tube). In contrast to conventional tubes, the water slide tube further includes a tube speed control assembly affixed to or attached to a lower or bottom portion of the cover (when optionally included) or outer coating of the inner tube. The tube speed control assembly includes one-to-many drag-inducing elements that are configured to create drag between the tube and the upper surface of water in the landing or catch pool. These drag-inducing elements apply braking forces upon the water slide tube causing it to slow in a stable manner within the desired or designed stop zone.

In one useful example, the tube speed control assembly includes a planar floor or base that is stretched over the hole of the tube (e.g., a sheet of plastic, fabric, or the like joined at a peripheral seam to the outer surface of the tube), and the planar floor or base includes one, two, three, four, or more drag-inducing elements in the form of holes each providing a water passageway through the floor or base. In this or other embodiments, a relief slit/opening may be provided in a rear (or aft) portion of the base/floor to provide a passageway for water passing through these holes to pass back out of the water slide tube. The speed control assembly may further include a support or reinforcing wall in an aft or rear portion (e.g., near the relief slit/opening) or that goes all the way around and is not limited to the rear (which would help in the case of a spun or reverse facing rider). The support or reinforcing wall extends between an inner surface/side of the base/plane to the outer surface of the tube about a fraction of the circumference of the tube hole to provide structural reinforcement in areas of the speed control assembly that are most subjected to forces from the water rushing into the tube from the holes in the base/floor.

More particularly, a water slide tube is provided that is adapted for braking during hydroplaning in a catch or landing pool of a water slide. The water slide tube includes a tube body (e.g., an inflatable torus-shaped or donut-shaped inner tube). Further, to provide braking, the water slide tube includes a tube speed control assembly, which has a floor or base attached to a bottom surface of the tube body. The assembly further includes one or more drag-inducing elements, provided in or on the floor, configured to produce drag when an outer surface of the floor travels over an upper surface of the catch or landing pool.

In some embodiments, the floor includes a sheet of flexible material joined along its peripheral edge to the tube body. The sheet of the floor typically includes a planar portion arranged to be tangential to the bottom surface of the tube body. Further, in some applications, the flexible material comprises rubber (e.g., PVC rubber or the like). Then, the tube body may be formed with a rubber wall, and the sheet of the floor is joined at a watertight seam to the tube body.

In the same or other embodiments, the one or more drag-inducing elements include at least one hole extending through the floor providing a passageway for water to an interior space of the tube body. More particularly, the at least one hole is typically located a distance rearward of a center of the tube body. In some instances, the drag-inducing elements include a pair of spaced apart holes positioned rearward of the tube body center and arranged to be symmetric relative to a center line of the tube body dividing the tube body into left and right halves. In some preferred cases, the pair of spaced apart holes both have an outer diameter of less than about 3 inches.

The drag-inducing elements may further include a second pair of spaced apart holes in a row parallel to the pair of spaced apart holes and also positioned rearward of the tube body center. The tube speed control assembly further may include a relief slit or mouth in the floor providing a passageway for water through the floor, and the relief slit is often positioned along a peripheral edge of the floor rearward of the at least one hole. In some preferred embodiments, the tube speed control assembly further includes a tube pocket disposed between, and coupled with, a peripheral edge of the floor and the bottom surface of the tube body.

DETAILED DESCRIPTION OF THE PREFERRED EMBODIMENTS

Figure 1:
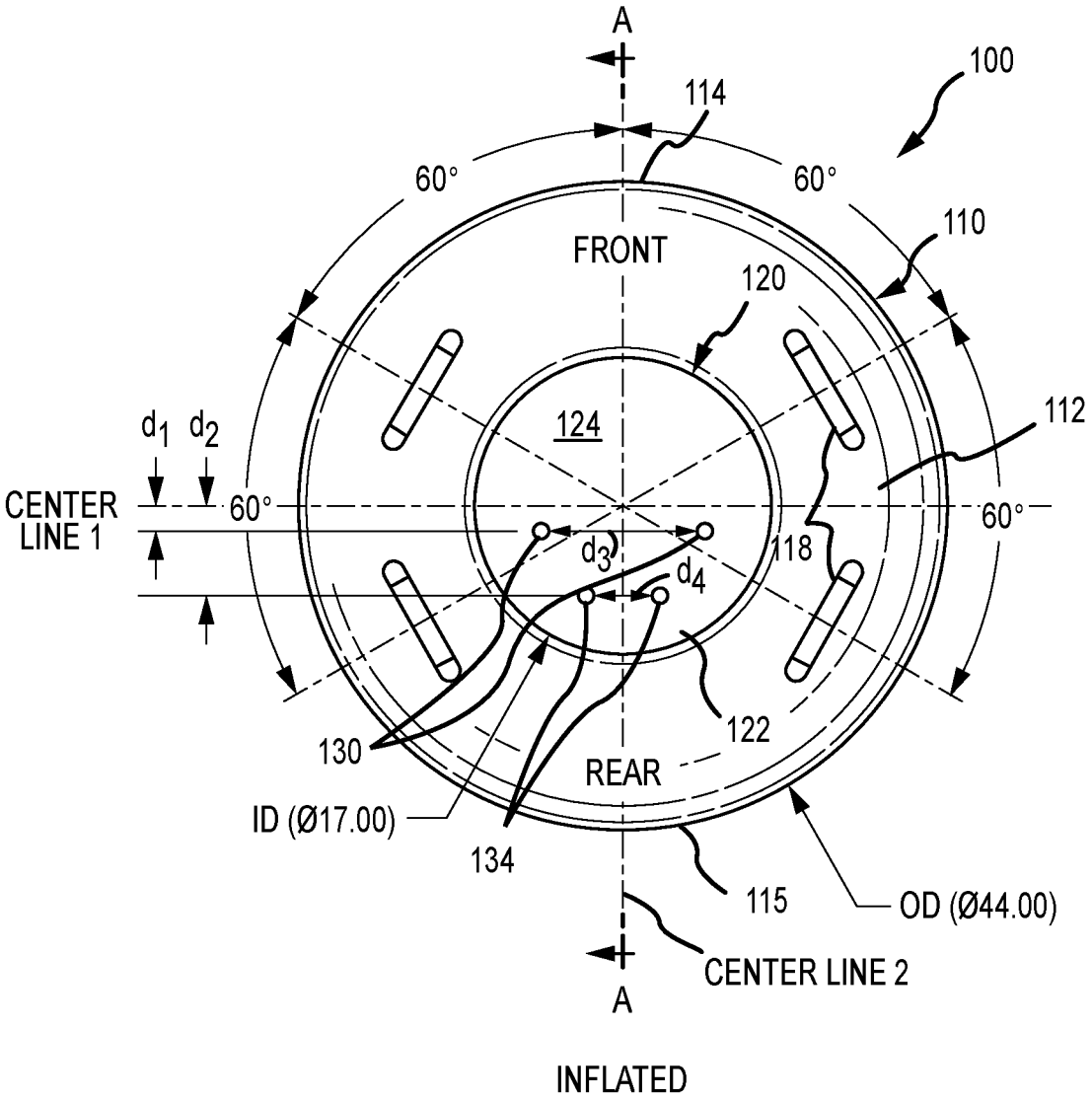
FIG. 1 is a top view of a water slide tube with a tube speed control assembly to provide braking while hydroplaning according to the present description.

Briefly, embodiments described herein are directed toward a water slide tube that is configured (e.g., with a tube speed control assembly) to increase drag while hydroplaning dependent on rider weight. A floor is added to a conventional tube configuration, and the floor (or base) is arranged to generally be at a tangent to the tube's bottom surface. The outer surface of the floor is generally planar or flat. This flat surface induces a planing effect when the tube travels across the upper surface of a landing pool by increasing the contact surface area of the water slide tube and by flattening the contact between the water slide tube and the top surface of the landing pool water. Due to this planing effect, rider stability is improved.

The tube speed control assembly further includes drag-inducing elements that may be provided in or on the floor. In one useful embodiment, the drag-inducing elements include holes cut through the floor (e.g., provide a water passageway through the floor between the outer and inner surfaces (or sides) of the floor). The holes can be cut into a strategic pattern near the rear half of the new floor such as with a leading pair of holes provided at about the center line of the water slide tube (a center axis extending through the tube's centrally located hole) and spaced apart on either side of the center axis and, optionally, a trailing pair of holes positioned toward a rear or aft portion of the floor (e.g., at a rear portion of the tube hole at a distance less than that used to separate the leading pair and, in some cases, on opposite sides of a relief slit/outlet in the floor).

During use in a water slide, water is forced through these holes in the floor and collected in the pocket created by the connection between the floor and the tube cover or outer coating layer. This pocket acts as a parachute, increasing drag and decelerating the water slide tube and its rider in the landing pool. A relief slit can be cut into the pocket (or portion of the floor providing a lower side of the pocket) to allow for smoother and less abrupt deceleration.

Heavier riders force the water slide tube deeper into the water of the landing pool. This pushes more water through the holes in the floor and into the pocket, which provides more drag than that experienced with a tube having a lighter weight rider. With this in mind, it can be appreciated that the braking force provided by the new water slide tube is dependent on the rider weight and will vary accordingly. The configuration of the drag-inducing elements (e.g., holes extending through the thickness of the floor/base material) and relief slit (when provided) can be varied to better suit differing slide types and slide design/use parameters. These parameters or variables may include slide profile, slide water flow, design stop location, landing pool water level, and the like.

Previous solutions to tube braking have almost exclusively been aimed toward tuning the slide water flow and the landing pool water depth. Slide water flow is defined as the flow of water that circulates down the slide providing propulsion and/or a frictionless surface (inner flume or slide surfaces or sidewalls) upon which the rider (and the tube) can slide. As this high velocity thin flow of water reaches the bottom of the slide, it reacts with the landing pool's slow velocity and deep flow of water, which creates turbulence. This turbulence phenomenon is often called a hydraulic jump and may technically be defined as the change from supercritical to subcritical flow. By tuning both the slide water flow and the landing pool water level, the slide designer can control the aggressiveness of the turbulence and its location translationally along the slide's path.

Hydraulic jumps are specifically used to slow riders at the end of a water slide. As the rider reaches the end of the slide, their tube collides with turbulent water, which reduces the rider's energy near the end of the slide. The hydraulic jump can then be tuned to match the slide. The more energy a rider possesses the more aggressive the turbulence is required in order to stop them. Location of the hydraulic jump is also important to consider in order to stop the rider in a designed stop location or zone within the landing pool. Other means of slowing riders on tubed water slides have included use of reverse injectors to create turbulence in the landing pool. This method relies on absorbing the energy of the water slide flow but is similar to the hydraulic jump technique in that the more energy the water slide flow possesses the more reverse flow is required in order to absorb that energy.

The new water slide tube design(s) provides a number of distinct advantages over prior methods of slowing tube riders in a landing pool. First, hydraulic jumps and all the methods that use turbulence to absorb rider energy sacrifice rider stability to decrease the tube and rider's energy. For slides that see a wide range of rider sizes, stability of all riders can be very useful and desirable. Heavy riders traveling at high speed require high turbulence to affect stopping. This high turbulence upon impact, though, can cause the rider to become very unstable on their tube. In these same high turbulence cases, a light rider traveling at high speed can experience even less stability upon striking the hydraulic jump or may not pass the hydraulic jump altogether due to less energy coming down the slide. In contrast, the brake-while-hydroplaning water slide tube described herein allows for a minimal turbulence (or small hydraulic jump) due to the deceleration being performed by the tube (or its drag-inducing elements of the tube speed control assembly). Due to the flat bottom of the new tube, stability is increased for all rider sizes.

A second advantage is that the water slide tube creates a variable braking force that is dependent in its magnitude on the rider size/weight. Methods that use turbulence as a means of braking do not vary depending on the size of the rider. Therefore, heavy and light riders experience different stopping results as far as their stop location in the landing pool. In some cases, light riders do not possess enough energy to even make it past the turbulence or hydraulic jump. Tuning water turbulence can be extensive and unpredictable. In order to maintain consistent turbulence, water slide flow should be consistent at all times, including while the rider is traveling in the slide. In contrast, because the new water slide tube does not rely on turbulence, controlling these operating parameters becomes much less critical. Also, because the new water slide tube induces a planing effect in order to operate, hydroplaning is more frequent or even guaranteed. Previous tube stopping methods have no braking ability once the rider has passed the hydraulic jump and has begun to hydroplane. Unlike prior stopping methods, the brake-while-hydroplaning water slide tube will decelerate during hydroplaning. Because the tube is designed to hydroplane, hydroplaning extended distances is reduced or even eliminated with the new water slide tube design.

Figure 2:
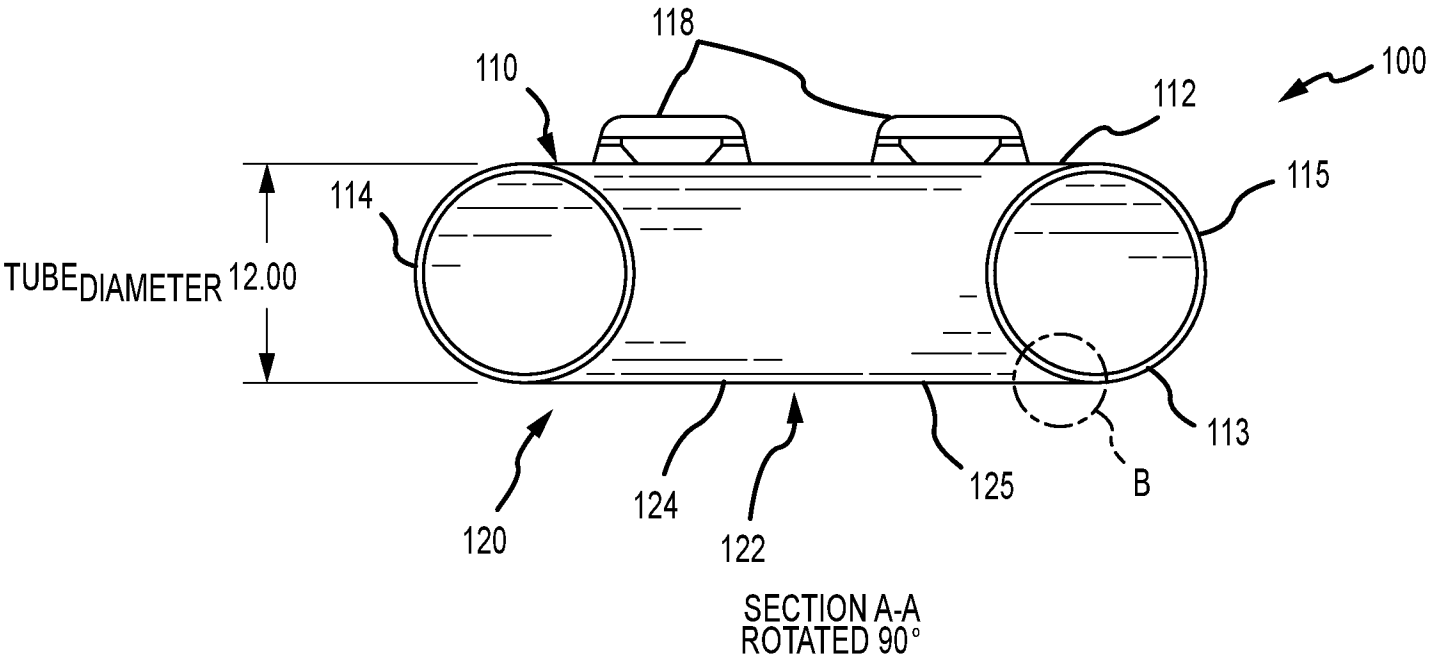
FIG. 2 is a sectional view of the water slide tube of FIG. 1 taken at Line A-A.

FIGS. 1 and 2 illustrate one exemplary embodiment of a water slide tube 100 of the present description that includes a tube speed control assembly 120. While the tube 100 may be constructed with an inner tube with an optional a fabric cover/outer coating (as discussed above), the water slide tube 100 is shown to be formed using a unitary design with an inner tube or donut-shaped (or torus) tube body 110. The tube body 110 is formed of a sheet of flexible material such as PVC rubber that is shown in an inflated state to have a diameter, $Tube_{Diam}$, such as in, but not limited to, the range of 8 to 16 inches (with 12 inches used in one prototype), an outer diameter, OD, such as in the range of 40 to 48 inches (with 44 inches used in one prototype), and a center hole diameter, ID, such as in the range of 13 to 21 inches (with 17 inches used in one prototype). Again, these are only exemplary dimensions for a useful tube design and other dimension and/or tube sizes may be used to implement the water slide tube 100.

The tube body 110 has a front or forward end 114, a rear or aft end 115, a top surface 112, and a bottom surface 113. The front end 114 generally is positioned by a rider to enter a water slide first, and the tube speed control assembly 120 is configured to provide stable braking with this orientation upon entering a landing pool. The water slide tube 100 includes two or more handles 118 on the top surface 112 to allow a rider to hold onto and position themselves on the tube body 110 over the center hole. The tube body 110 is symmetric and can be divided equally into forward and rear halves with a first center line, Center Line 1, and left and right halves with a second center line, Center Line 2 (that intersects the first center line at a center of the of the water slide tube 100 and is orthogonal to the first center line).

To provide braking during hydroplaning in a landing pool (while allowing smooth sliding down the slide/flume), the water slide tube 100 includes the tube speed control assembly 120. The assembly 120 includes a floor/base 122 and one-to-many drag-inducing elements. The floor/base 122 may be formed of a sheet of flexible material similar to or matching that of the tube body 110 such as PVC rubber or the like, and the floor/base 122 may be glued or joined along its periphery to the bottom surface 113 of the tube body 110. In this way, the floor/base 122 may be stretched taut with a planar upper/inner surface 124 and a planar lower/outer surface 125.

During use in a water slide, the lower/outer surface 125 provides a water-contacting surface that allows the tube 100 to glide relatively drag-free in the slide/flume and facilitates hydroplaning and stability when the tube 100 exits the slide/flume and travels across the upper surface of a landing/ catch pool. To this end, the outer surface 125 may be positioned as shown in FIG. 2 to be tangent with the tube body 110 at the bottom surface 113. The drag-inducing elements may take a variety of forms to brake the tube body 110 in a landing pool such by selection of the material for the floor 122 to have a plurality of ridges or bumps (e.g., by choosing a surface roughness or by providing alternating ridges and grooves that are parallel to the first center line, Center Line 1 so as to be orthogonal to the direction of travel during use of tube 100).

In some preferred embodiments, the drag-inducing elements are provided as one, two, three, four, or more holes in the floor 122 that provide water passageways from the outer surface 125 to the inner surface 124 of the floor 122. The holes may be circular in shape or any other useful shape such as oval, rectangular, triangular, and the like. In this way, water from the landing pool flows during hydroplaning into the interior spaces of the tube body 110 in its center hole. This water flow action applies drag forces on the tube 100 that acts to brake the tube 100 causing it to stop in a desired catch or stop zone of the landing pool.

In one prototype, the drag-inducing element was provided as a single relatively large (e.g., 3 to 5-inch OD hole) hole. The hole was positioned on the floor 122 to have its center located along the second center line, Center Line 2, at a location more proximate to the rear side 115 of the tube body 110 than the front side 114 (e.g., 1 to 3 inches or more from the center of the tube body 110). This location provides stability during braking by avoiding spinning the tube 100 when drag or braking forces are applied. In another prototype, a pair of spaced apart holes were arranged at or behind the first center line, Center Line 1, and arranged symmetrically about the second center line, Center Line 2, to distribute the braking forces in a symmetric manner to avoid spinning the tube body 110 during slowing in the landing pool. The use of two holes for the drag-inducing elements is useful to allow smaller holes (e.g., ODs of less than about 3 inches) to prevent/limit a rider's foot or hand extending through the holes. In other embodiments, three or more holes are provided in a single or two or more rows in the floor 122, again with a symmetric arrangement relative to the second center line, Center Line 2, with more holes/drag-inducing elements being desirable in some cases to increase stability by spreading the braking/drag forces along the floor 122.

In this regard, FIG. 1 shows one preferred embodiment of the tube speed control assembly 120 with planar floor 122 that includes first and second pairs of holes 130, 134. The first pair of holes 130 is arranged in a first row parallel to the first center line, Center Line 1 so as to have their centers spaced apart a distance, $d_1$, from the first center line, Center Line 1 (e.g., 0 to 6 inches or the like) and to be spaced apart from each other on opposite sides of the second center line, Center Line 2 (e.g., a distance, $d_3$, in the range of 6 to 12 inches or the like so as to be symmetrically arranged). The second pair of holes 134 is arranged in a second row also parallel to the first center line, Center Line 1 to have their centers spaced apart a distance, $d_2$, from the first center line, Center Line 1 (e.g., greater than the first distance, d1, at 3 to 12 inches or the like) and to be spaced apart from each other on opposite sides of the second center line, Center Line 2 (e.g., a distance, $d_4$, in the range of 4 to 10 inches or the like so as to be symmetrically arranged and, as shown, to be closer to the second center line, Center Line 2, so as to not be directly behind the first holes 130). The holes 130, 134 are shown to have the same OD (e.g., in the range of 0.5 to 3 inches), but this is not a requirement and the holes 130 may be smaller in OD than the holes 134 in some preferred case (e.g., to apply more drag force toward the rear end 115 of the tube body 110). To strengthen the holes 130, 134, a reinforcing ring may be provided along each of their inner edges.

Figure 3:
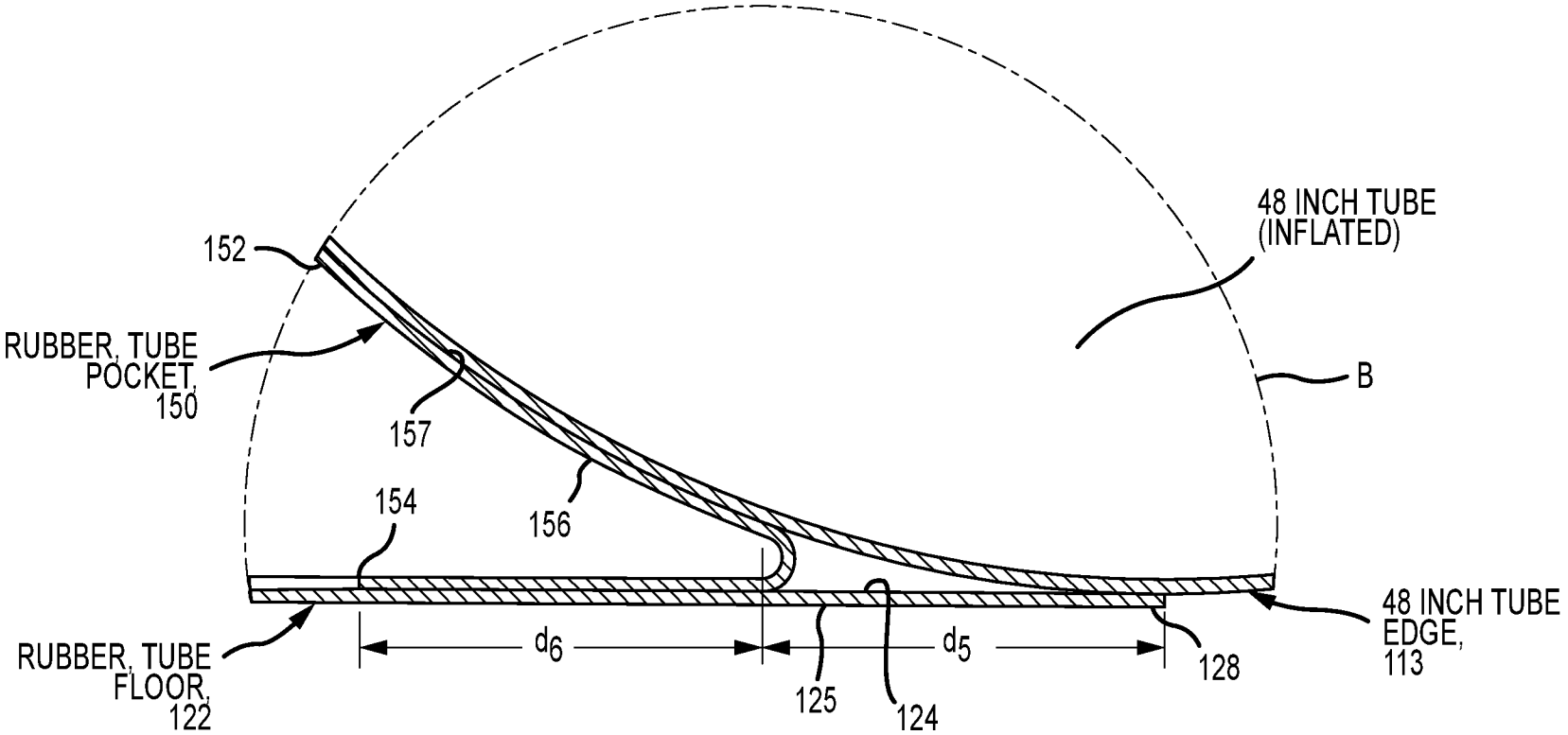
FIG. 3 is a partial detailed view of a portion of the water slide tube of FIG. 2 that provides an enlarged view showing details of the floor or planar base of the tube speed control assembly including a tube pocket or reinforcement wall disposed between the floor and the inner bottom side of the inner tube or tubular body.

FIG. 3 illustrates a detailed view taken from FIG. 2 that shows both an example of fabricating the floor 122 and also showing use of a reinforcing wall or tube pocket 150. As shown, the outer or peripheral edge 128 of the tube floor 122 may be glued or welded (or otherwise joined) to the bottom surface 113 of the tube body 110 so as to be planar and tangent to the tube body 110. Typically, the seam formed between the surface 113 and the floor edge 128 is watertight and extends about the entire floor 122. To increase the strength and durability of the water slide tube 100, a tube pocket 150 is added that can be formed of a sheet of the same or a different flexible material as the floor 122 (e.g., a rubber sheet). The tube pocket 150 has an inner surface 156 that receives water flowing through the holes 130, 134 and an outer surface 157 that is affixed (e.g., glued, welded, or the like) at one end 152 to the bottom surface 113 of the tube body 110 and along a second end 154 to the inner surface 124 of the floor 122 to provide a generally U or V-shaped cross-sectional shape to catch water entering the tube's inner hole/holes through the floor 122, such as with matching dimensions, $d_5$ and $d_6$ (e.g., 1.5 to 3 inches or more for each). The pocket 150 may extend for all or a portion of the bottom surface 113 (e.g., only about ⅓ or ½ of the circumference to be at or near the rear side 115 of the tube body 110).

Figure 4:
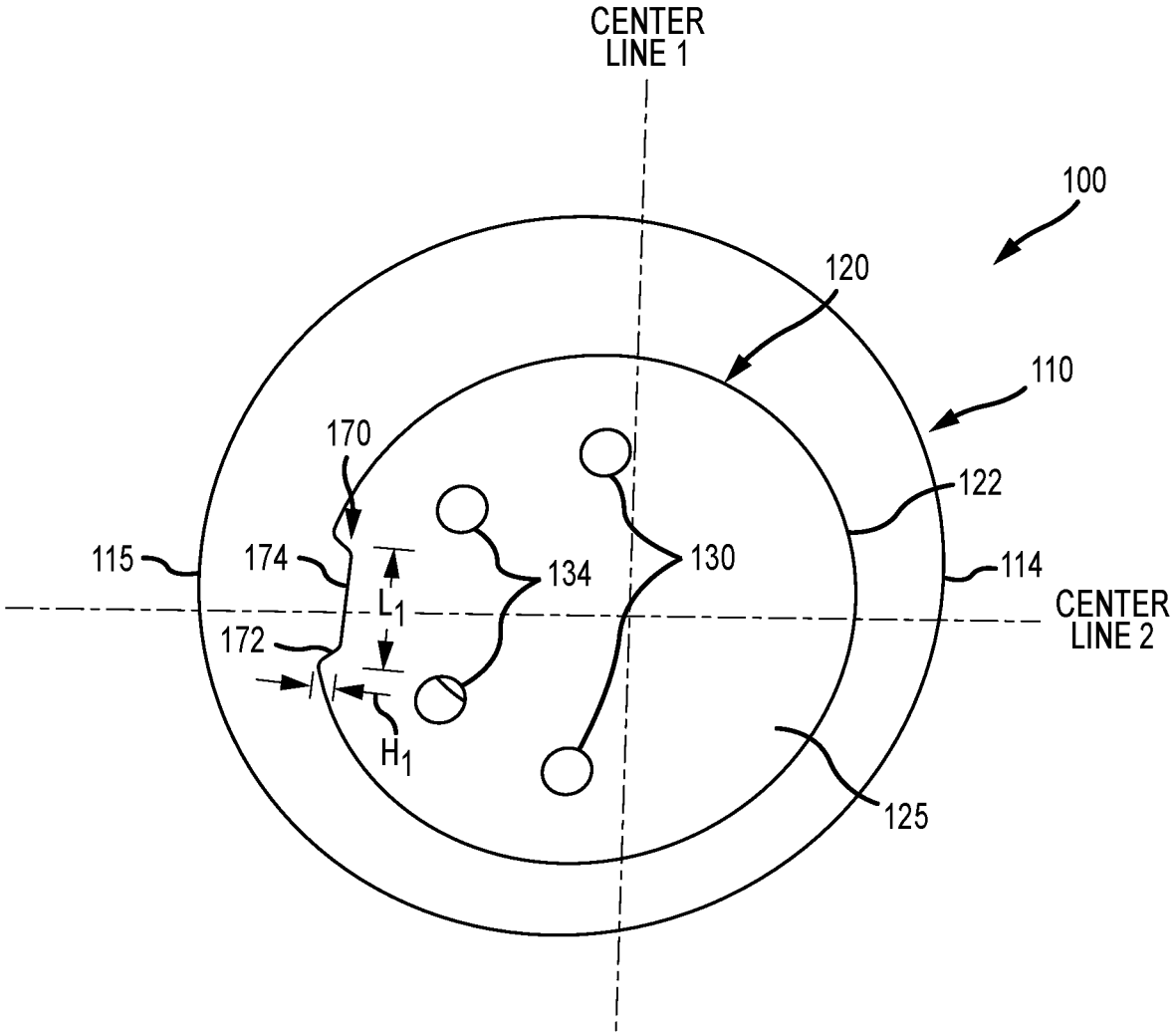
FIG. 4 is a bottom perspective view of the water slide tube of FIG. 1 showing one embodiment of a set of drag-inducing elements in the floor/planar base combined with a relief slit/opening at an aft or rear edge of the floor/planar base.

In some embodiments, it may be desirable to more gradually brake or slow the water slide tube to avoid stops that are too abrupt. Such brake rate control may be provided as shown in FIG. 4 by including a relief slit/opening 170 in the floor 122. During use, the relief slit/opening 170 allows water that passes through the holes 130, 134 into the interior space of the tube body 110 to escape or flow back out into the landing pool. In this manner, a desired volume of water may be caught to assist in braking the tube 100 but some volume is allowed to escape to provide a smoother and more stable braking experience for tube riders.

The exact configuration of the relief slit/opening 170 may vary greatly to practice the water slide tube 100 so as to tune or set water flow out from the tube 100 to the holes 130, 134, to the particular water slide or landing pool, to achieve stoppage in a particular catch or stoppage zone in the landing pool, and so on. In the example of FIG. 4, the relief slit is generally rectangular in shape with angled (e.g., 15 to 45 degrees) sidewalls 170, 172 extending (e.g., 0.5 to 2 inches in length to provide a desired slit height, $H_1$, of 0.25 to 1.75 inches) from the peripheral edge of the floor 122 to an inner edge 174 (e.g., 2 to 6 inches in length to provide a slit length, $L_1$) that may be orthogonal to the second center line, Center Line 2, and the direction of travel in the landing pool.

Figure 5:
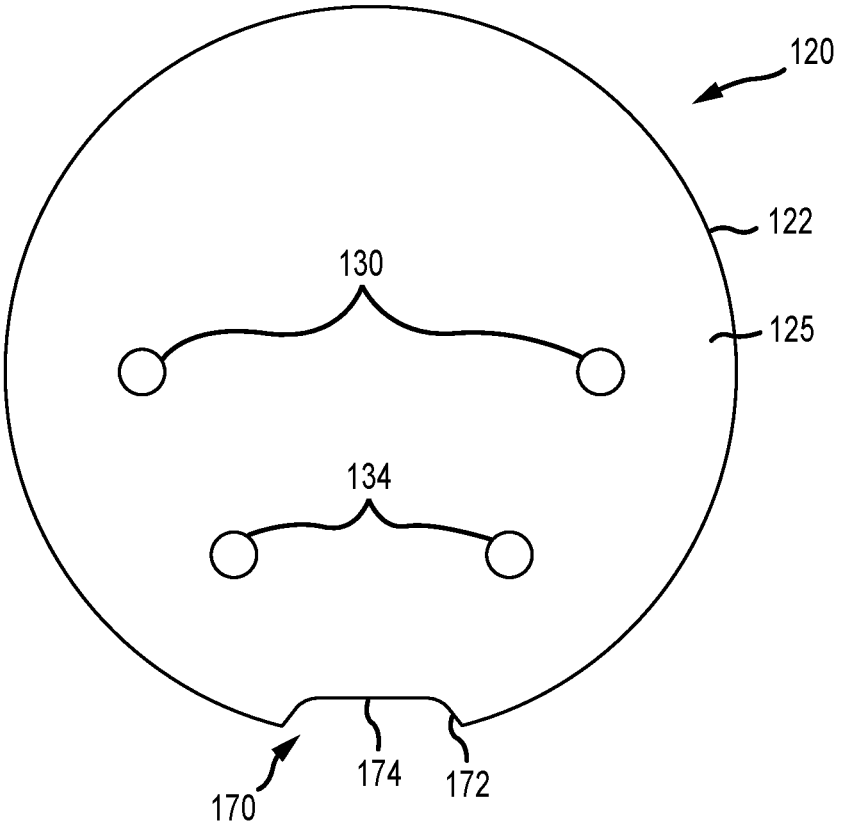
FIG. 5 is a bottom view of the tube speed control assembly of FIG. 4 prior to mounting upon the inner tube (or tubular body) of the water slide tube.
Figure 6:
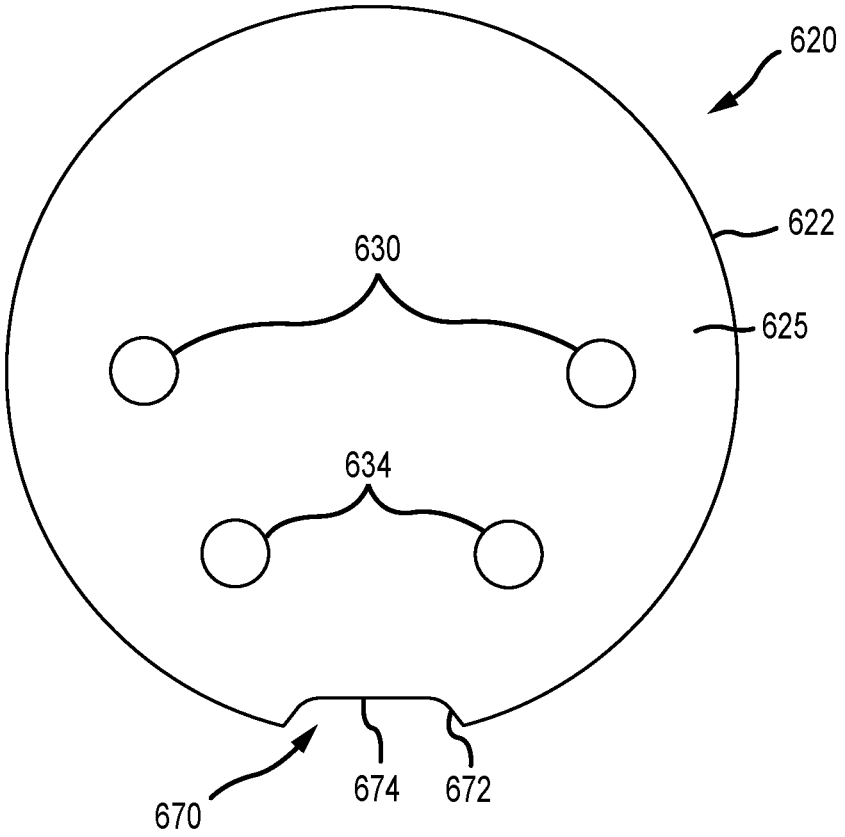
FIG. 6 is a bottom view similar to FIG. 5 showing another embodiment of a tube speed control assembly of the present description.

FIG. 5 illustrates a top view of the tube speed control assembly 120 of the tube 100 showing more detail of the arrangement of the drag-inducing elements 130, 134 and relief slit/opening 170. FIG. 6 illustrates another embodiment of the tube speed control assembly 620 with a floor 622 with a bottom surface 625 and a relief slit/opening 670 (at a rear point of the periphery of the floor 622) similar to slit 170 with sidewalls 672 and an inner edge 674. The assembly 620 differs from assembly 120 due to the inclusion of larger diameter holes 630 and 634 than holes 130 and 134. This is useful for showing that the overall surface area provided by holes 630 and 634 (or 130 and 134) may be tuned to achieve desired drag or braking forces in a landing pool, with larger holes and/or overall hole surface area providing greater drag and stoppage of a hydroplaning tube in a landing or catch pool.

Figure 7:
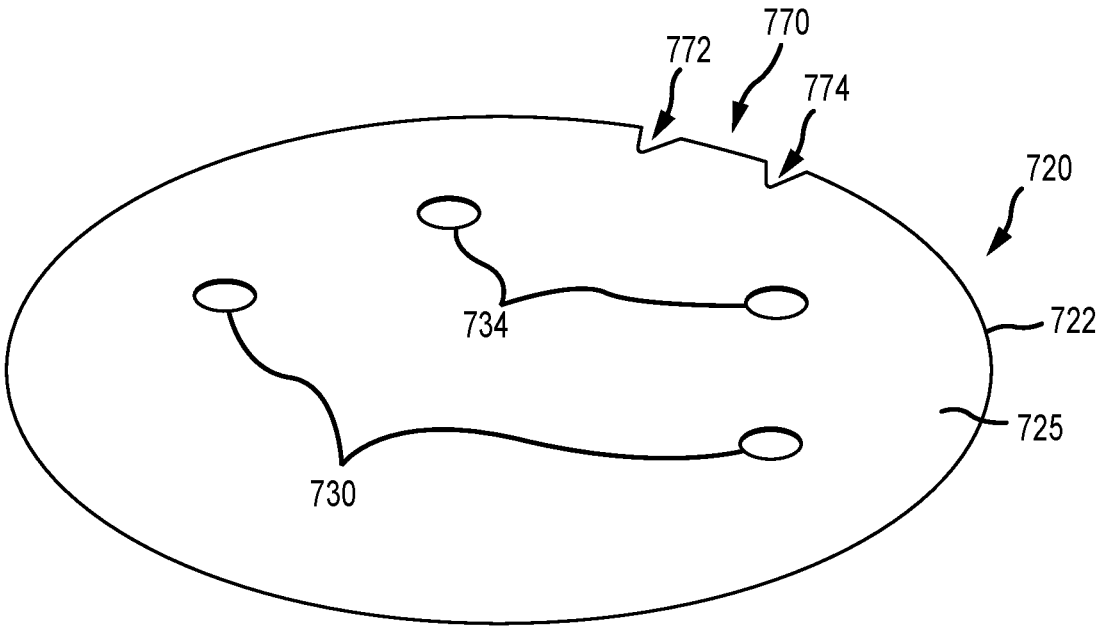
FIG. 7 is a bottom perspective view similar to FIGS. 5 and 6 showing yet another embodiment of a tube speed control assembly showing a different relief slit/opening configuration.

FIG. 7 illustrates another embodiment of a tube speed control assembly 720 with holes 730, 734 in a floor/base 722 in a pattern similar to those in FIGS. 5 and 6, but with the first or forward row of holes 730 further forward (e.g., with centers at or even forward of the first center line of the tube body 110) to generate differing braking effects, and outer surface 725 assists in hydroplaning. The embodiment 720 further differs in that the relief slit/opening 770 has a differing configuration being formed with two V-shape cuts or recessed surfaces (e.g., with a 0.5 to 2 inch depth or the like) in the rear peripheral portion of the floor 720. As will be understood, the volume of water allowed to flow back out of the tube after capturing through holes 730, 734 can be tuned by varying the shape, number, and size of these openings 772, 774. Generally, though, as with the holes 730, 734, it is desirable for the slit/opening 770 to provide equal flow on both sides of the second center line of the tube body so the openings/recessed surfaces 772, 774 are typically arranged symmetrically relative to this center line.

Figure 8:
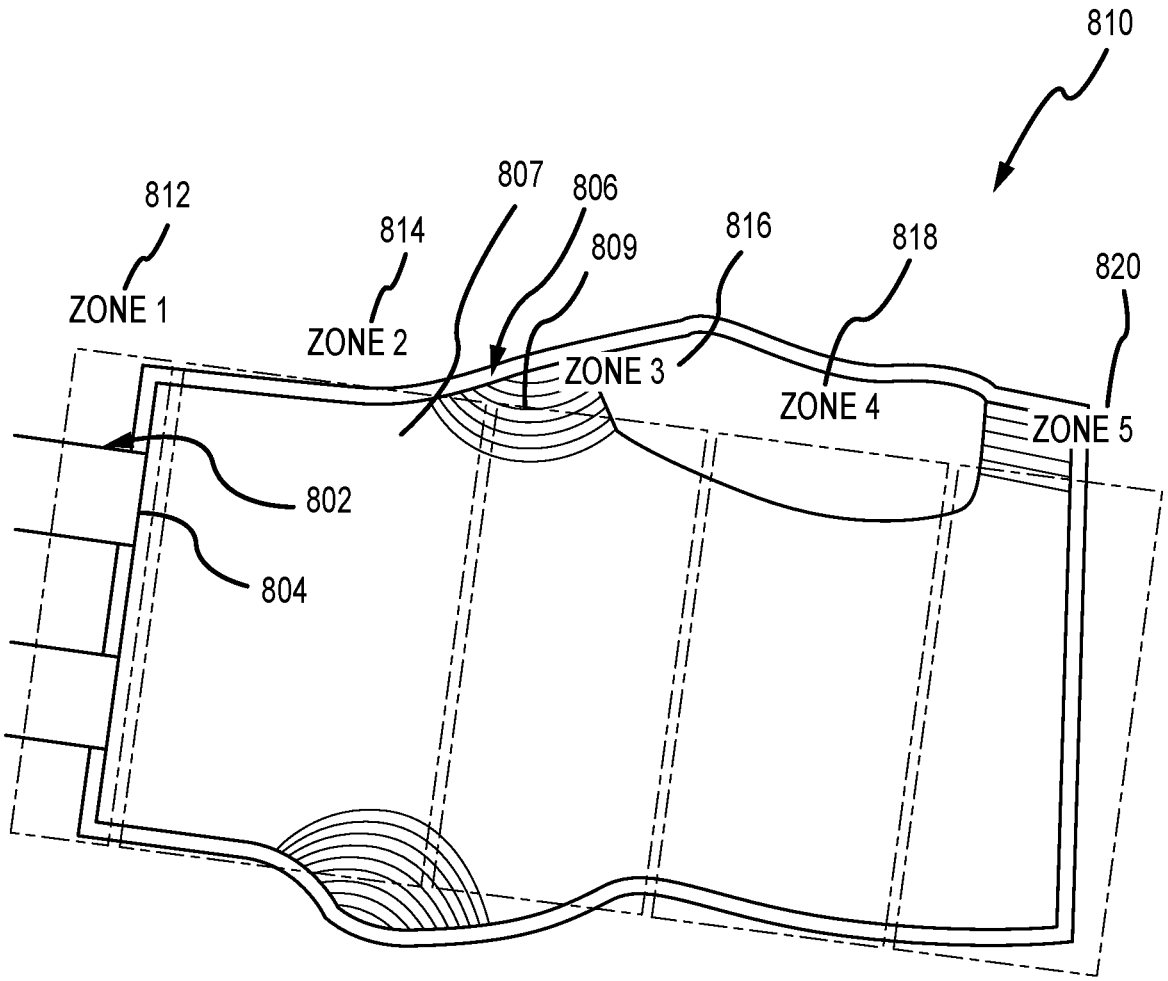
FIG. 8 is a top view of an exemplary water slide with a landing or catch pool at the outlet of the water slide showing various stop zones for a water slide tube and its rider.

FIG. 8 illustrates a top view of a water slide system 810 with a slide/flume 802 with an outlet 804 at the edge of a landing pool 806 filled with a depth (e.g., 3 feet or the like) of water 808. An egress (e.g., stairs) 809 is provided along one (or both) sides of the pool 806. The pool 806 may be divided up into a set of catch/stoppage zones as shown with zones 812, 814, 816, 818, and 820 that extend from the outlet 804 to a back or end wall of the pool 806. In use, it may be desirable for a rider of a water slide tube of the present description to be able to hydroplane through the first zone 812 near the slide flume outlet 804 and into or through at least a portion of the second zone 814. During this hydroplaning, it may also be desirable that the drag-inducing elements in the floor of the water slide tube apply drag/braking forces to slow the tube to cause the tube and its rider to stop in a desired stop zone, with one non-limiting design calling for stopping in the second zone 814 or the third zone 816 but definitely by or in the fourth zone 818 in most applications. This is true regardless of the size and/or type of rider. Testing with prototypes of the water slide tube described herein has proven that the new tube design is effective in achieving these goals.

Specifically, testing of the concept tube showed that a more consistent stop zone (e.g., one nearer the slide outlet and/or near a pool exit point) can be achieved while maintaining or improving rider stability for sizes of riders varying from small children to large teenagers or adults. In the testing, it was determined that with the designs taught herein that the riders still had the ability to hydroplane for at least some distance, and braking was achieved while varying slide operation parameters including varying water flow and catch pool water levels (e.g., to achieve a relatively small hydraulic jump). The tube design was tested in a speed slide with speeds at the outlet of about 30 mph. In one test run, all riders (even larger and/or athletic ones) had stop locations in the first or second zones 814, 816 of FIG. 8.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

It was determined that the combination of a planar floor with drag-inducing elements provided desirable deceleration while allowing most riders to hydroplane with stability. For many applications, it was also determined that a smaller or flatter hydraulic jump is desirable with the new water slide tube to provide more consistent stop locations or lengths. The tube speed control assembly may be designed considering the following variables: hole location (but often start behind center of floor and symmetrically arranged relative to center line extending from front to rear sides of tube body); hole size; hole shape; and hole number. One alternative embodiment (not shown) uses a second panel or floor located parallel to and inward from the floors shown and described herein, and the second panel may be a solid sheet to block water from traveling up into the tube's interior space or its hole.

We claim:

1. A water slide tube adapted for braking during hydroplaning, rising:

a tube body; and a tube speed control assembly comprising a floor attached to a bottom surface of the tube body, wherein the floor includes one or more drag-inducing elements configured to produce drag when an outer surface of the floor travels over an upper surface of a pool, and wherein the floor comprises a sheet of flexible material joined along its peripheral edge to the tube body.

2. The water slide tube of claim 1, wherein the sheet includes a planar portion arranged to be tangential to the bottom surface of the tube body.

3. The water slide tube of claim 2, wherein the flexible material comprises a rubber or a thermoplastic, wherein the tube body comprises a rubber or thermoplastic wall, and wherein the sheet of the floor is joined at a watertight seam to the tube body.

4. The water slide tube of claim 1, wherein the one or more drag-inducing elements include at least one hole extending through the floor providing a passageway for water to an interior space of the tube body.

5. The water slide tube of claim 4, wherein the at least one hole is located a distance rearward of a center of the tube body.

6. The water slide tube of claim 5, wherein the drag-inducing elements comprise a pair of spaced apart holes positioned rearward of the tube body center and arranged to be symmetric relative to a center line of the tube body dividing the tube body into left and right halves.

7. The water slide tube of claim 6, wherein the pair of spaced apart holes both have an outer diameter of less than about 3 inches.

8. The water slide tube of claim 6, wherein the drag-inducing elements further comprise a second pair of spaced apart holes in a row parallel to the pair of spaced apart holes and also positioned rearward of the tube body center.

9. The water slide tube of claim 4, wherein the tube speed control assembly further includes a relief slit in the floor providing a passageway for water through the floor and wherein the relief slit is positioned along a peripheral edge of the floor rearward of the at least one hole.

10. The water slide tube of claim 4, wherein the tube speed control assembly further comprises a tube pocket disposed between, and coupled with, a peripheral edge of the floor and the bottom surface of the tube body.

11. A water slide tube adapted for braking during hydroplaning, rising:

an inflatable, donut-shaped tube;

a floor attached to a bottom surface of the tube;

drag-inducing elements exposed on an outer surface of the floor, wherein the drag-inducing elements are configured to brake the tube when the outer surface of the floor travels over an upper surface of water in a pool; and a tube pocket disposed between, and coupled with, a peripheral edge of the floor and the bottom surface of the tube.

12. The water slide tube of claim 11, wherein the floor includes a planar portion arranged to be tangential to the bottom surface of the tube.

13. The water slide tube of claim 12, wherein the floor is joined at a watertight seam to the tube formed along its periphery.

14. The water slide tube of claim 11, wherein the one or more drag-inducing elements include at least one hole extending through the floor providing a passageway for water to an interior space of the tube and wherein the at least one hole is located a distance rearward of a center of the tube.

15. The water slide tube of claim 11, wherein the drag-inducing elements comprise a pair of spaced apart holes positioned rearward of the tube center and arranged to be symmetric relative to a center line of the tube dividing the tube into left and right halves.

16. The water slide tube of claim 15, wherein the drag-inducing elements further comprise a second pair of spaced apart holes in a row parallel to the pair of spaced apart holes and also positioned rearward of the tube center.

17. The water slide tube of claim 15, further including a relief slit in the floor providing a passageway for water through the floor and wherein the relief slit is positioned along a peripheral edge of the floor rearward of the at least one hole.

18. A water slide tube adapted for braking during hydroplaning, rising:

a tube body; and a tube speed control assembly comprising a floor attached to a bottom surface of the tube body, wherein the floor includes one or more drag-inducing elements configured to produce drag when an outer surface of the floor travels over an upper surface of a pool, wherein the one or more drag-inducing elements include at least one hole extending through the floor providing a passageway for water to an interior space of the tube body, and wherein the tube speed control assembly further comprises a tube pocket disposed between, and coupled with, a peripheral edge of the floor and the bottom surface of the tube body.

19. The water slide tube of claim 18, wherein the floor comprises a sheet of flexible material joined along its peripheral edge to the tube body and wherein the sheet includes a planar portion arranged to be tangential to the bottom surface of the tube body.

20. The water slide tube of claim 19, wherein the flexible material comprises a rubber or a thermoplastic, wherein the tube body comprises a rubber or thermoplastic wall, and wherein the sheet of the floor is joined at a watertight seam to the tube body.

21. The water slide tube of claim 18, wherein the at least one hole is located a distance rearward of a center of the tube body.

22. The water slide tube of claim 21, wherein the drag-inducing elements comprise a pair of spaced apart holes positioned rearward of the tube body center and arranged to be symmetric relative to a center line of the tube body dividing the tube body into left and right halves.

23. The water slide tube of claim 22, wherein the pair of spaced apart holes both have an outer diameter of less than about 3 inches.

24. The water slide tube of claim 22, wherein the drag-inducing elements further comprise a second pair of spaced apart holes in a row parallel to the pair of spaced apart holes and also positioned rearward of the tube body center.

25. The water slide tube of claim 18, wherein the tube speed control assembly further includes a relief slit in the floor providing a passageway for water through the floor and wherein the relief slit is positioned along a peripheral edge of the floor rearward of the at least one hole.

* * * * *